United States Patent [19]

Harsia et al.

[11] Patent Number: 4,779,552

[45] Date of Patent: Oct. 25, 1988

[54] SHIP CONSTRUCTION

[75] Inventors: Pirjo Harsia, Klaukkala; Kai Levander, Kauniainen; Dan Westerlund, Helsinki, all of Finland

[73] Assignee: Oy Wartsila Ab, Helsinki, Finland

[21] Appl. No.: 9,383

[22] Filed: Jan. 30, 1987

[30] Foreign Application Priority Data

Feb. 11, 1986 [FI] Finland ..... 860628

[51] Int. Cl.[4] ..... B63B 9/00

[52] U.S. Cl. ..... 114/65 R; 114/71; 114/78; 114/85; 52/79.12

[58] Field of Search ..... 114/65 R, 71, 77 R, 114/78, 85, 189, 83; 52/79.1, 79.2, 79.6, 79.9, 79.12

[56] References Cited

U.S. PATENT DOCUMENTS

| | | | |
|---|---|---|---|
| 2,152,605 | 3/1939 | Ragsdale et al. | 114/71 |
| 3,229,433 | 1/1966 | Miles | 114/85 |
| 3,363,597 | 1/1968 | Zeien | 114/65 R |
| 3,525,186 | 8/1970 | Lombardo | 52/79.12 |
| 3,541,744 | 11/1970 | Maxwell | 52/79.12 |
| 3,638,380 | 2/1972 | Perri | 52/79.12 |
| 3,823,520 | 7/1974 | Ohta et al. | 52/79.12 |
| 4,528,928 | 7/1985 | Virta et al. | 114/189 |
| 4,594,817 | 6/1986 | McLaren et al. | 52/79.12 |

*Primary Examiner*—Sherman D. Basinger
*Assistant Examiner*—Stephen P. Avila
*Attorney, Agent, or Firm*—Dellett, Smith-Hill and Bedell

[57] ABSTRACT

The invention relates to a method for building a passenger section consisting of several cabin units (7) or similar in the superstructure of a ship with several floor levels located above the actual hull on the topmost deck (1) covering the entire hull of the ship. The passenger section is assembled by installing prefabricated cabin units (7) with a bottom construction embodying sufficient local strength so, that they are supported by at least one self-supporting three-dimensional latticework or frame consisting of braced girders (3, 3', 4, 5) or similar, the requisite overall strength of the superstructure being substantially based on this latticework or frame.

16 Claims, 4 Drawing Sheets

SHIP CONSTRUCTION

The invention relates to a method for the construction of a ship's superstructure using prefabricated elements and to a ship structure.

In the assembly of ships' passenger sections it is a well-known practice to use units which are pre-assembled to an advanced stage before being transferred into the ship. By assembling ships from prefabricated and pre-fitted units, such as cabin elements, it has been possible to eliminate more and more of the work that needs to be carried out in the confined space on board the ship. Naturally, at the same time the actual building and assembly of the ship can be speeded up considerably. When the passenger section of a ship is constructed using elements, the simplest method is to arrange the units on the load-bearing deck, stacked up in layers and positioned in rows. In an advantageous solution, such as that defined in U.S. Pat. No. 4,528,928, the elements are self-supporting units without any bottom construction, but the deck plate forms the bottom of the cabins.

As the passenger section is being installed within the hull, it is also a well-known practice to fit the walls of the hull with cantilever type bulkheads on which the self-supporting cabin elements with bottom constructions are then placed. An alternative method of arranging the support for such elements is described in U.S. Pat. No. 3,363,597; according to this, a matrix of girders is arranged in an enclosed space within the hull, the matrix is then supported on the walls of the hull, and modules without bottoms are suspended within the matrix.

However, in the case of large passenger liners, particularly the so-called cruise liners, the aim is to locate a majority of cabins in a superstructure extending above the actual hull of the ship. The market value of a cabin located on a higher level is higher. Moreover, in a superstructure located above the highest deck which covers the entire hull, it is possible to implement in the layout of cabins more passenger-friendly solutions, for example with regard to the arrangement of panoramic windows and balconies, than what is possible in the case of the ship's actual hull. This is due to the fact that national and international standards governing ship design and construction are very strict where the actual hull is concerned. In the construction of the superstructure the principal restricting factor, apart from fire safety and other such regulations, is the weight of the structure. Ship standards specify that vessels must meet a minimum stability requirement, which does not allow for a very heavy weight to be located high above the waterline.

In the known techniques, superstructures are always constructed in such a way that cabins or cabin elements are located on load-bearing decks. The purpose of a stiffened deck has, therefore, been to ensure both overall and local strength. The term 'overall strength' in this case refers to the structural strength and rigidity of the superstructure as a whole, while the term 'local strength' refers to the strength and rigidity that is required locally, for instance in the floor of the cabin, in order to withstand the stresses occurring in this particular structure.

The object of this invention is to create a new and more economical system for constructing the superstructure of a passenger liner. Another object is to create a building method and a construction that essentially reduce the structural weight of the superstructure and achieve savings in space, thus enabling a more spacious superstructure to be used without the ship's stability being affected. Yet another object of the invention is to achieve a building method suited particularly well to the utilization of prefabricated construction elements comprising at least ceiling, bottom and walls.

The object of the invention is achieved by utilizing those charactristic features of the invention, which are defined in claim 1. By making the load-bearing frame of the ship's superstructure from a self-supporting three-dimensional latticework or frame consisting of braced girders, with the self-supporting cabin elements with bottom or base structure resting on this latticework or frame, considerable weight savings can be achieved in the superstructure without the overall strength or rigidity, nevertheless, being affected. Owing to this reduced weight, the number of cabins or similar units forming the superstructure may be increased, for example by the addition of further levels.

According to known techniques, the frame of a ship's superstructure is assembled using reinforced steel plates which cover the entire decks of the superstructure and which produce both the overall strength of the superstructure and also the local strength required. Usually this consists, for example, of a 5 to 6 mm thick deck made from steel plate which together with the cross braces has an overall thickness of some 300 mm. The local strength of such a structure which has to withstand, for example, the stresses acting on the base of the cabin, however, hereby considerably exceeds the requisite strength when this type of structure is used. The idea behind the invention is to reduce the weight of the structure in places where only local strength is required by replacing the covering steel deck structure with a lighter structure which provides adequate strength with regard to what is required. In principle the new structure could be described as the cutting of holes in the covering deck structure so that the holes correspond to the cabin base sections and locating cabin elements with base structure into these holes. In practice, according to the method described below, the entire deck structure is substituted by latticework consisting of girders, this acting as a support for the cabin elements. With this type of latticework it is possible to achieve the overall strength and rigidity required by the superstructure. Apart from the weight saving, another advantage offered by this invention is the saving of space, as the space left between the various levels of a superstructure constructed in accordance with this method can be very expediently reduced as compared with the known techniques, as shown in the following.

According to international ships classifications, the deck shall be able to meet the requirements of the highest fire-proof class A-O, which hereto has meant a steel plate of at least 4 mm thickness. It has been proved in committed tests, that a sandwich-structure according to the invention is able to fulfill the requirements of this fire-proof class A-O.

With a three-dimensional latticework which is affixed to the topmost deck of the ship's hull and which is fitted with the necessary cross braces, it is possible to achieve the requisite load-bearing overall strength and rigidity. However, it is often an advantage to provide the superstructure with a wall or similar to increase strength and to act as a side support for the lattices in order to increase rigidity. In an advantageous design, for example in the way indicated in Patent Publication GB No. 2 110

603, there is in the longitudinal direction of the superstructure an intermediate space occupying the central section and running through all the levels, the outer walls of which space act as supports for the latticework frames. In fact, this embodiment of the present invention may be regarded as an innovative development of the disclosure of Great Britain Pat. No. 2 110 603, the content of which hereby is incorporated as reference.

The intermediate space is thereby used for the installation of ventilation system components, access routes as well as pipework and other similar equipment. Also in the transverse direction of the superstructure it may be advantageous to arrange partitions affixed to the ship's hull and increasing strength which at the same time offer the added advantage of acting as firewalls.

The invention may, of course also be applied for other structures of a ship's superstructure. One feasible embodiment is, for example, an atrium-type superstructure, with a wide open space between two rows of cabins. Hereby the outer longitudinal bulkheads favourably are made of a covering steel plate, which improves the rigidity of the superstructure.

In one embodiment the cabin elements comprising a bottom construction are installed inside the frame by pushing from the outboard direction between the outboard pillars of the frame. This method allows for the prefabrication and assembly of the frame before commencement of cabin element installation. In another embodiment the cabin elements are installed from above so that the horizontal supporting girders of the frame which carry the weight of the cabin elements are installed in the frame only after the installation of the lower cabin elements. In each case it is an advantage to install the outer bulkheads and window elements of the outside cabins separately. In other words, the prefabricated cabin elements are without an outer wall. Alternatively, a prefabricated cabin unit may also include an outer wall. In order to install possible balconies, walking decks or lifeboat arrangements outside the actual passenger cabin complex, it is preferable to arrange the frame support girders so that some of them extend, in the crosswise direction, outside the actual passenger section.

The self-supporting base section of the passenger cabin and the related corridor section is made from a layered so-called sandwich structure consisting of corrugated sheet metal. A structure of this type offers good strength in view of its weight, and also very good insulation.

The method described is very well suited to the construction of a passenger section consisting of prefabricated cabin elements. A passenger liner corresponding to claim 6 may, naturally, be constructed also by assembling the cabin units only on board the ship. In the latter case too, the load-bearing frame of the superstructure to be built will consist of three-dimensional latticework, the lightweight deck of sandwich-type structure being supported by this latticework at the deck openings which have been left open by the latticework.

The invention is described more accurately in the following, with references to the attached drawing, in which FIG. 1 shows a general view of the three-dimensional latticework according to the invention;

Figure 1:
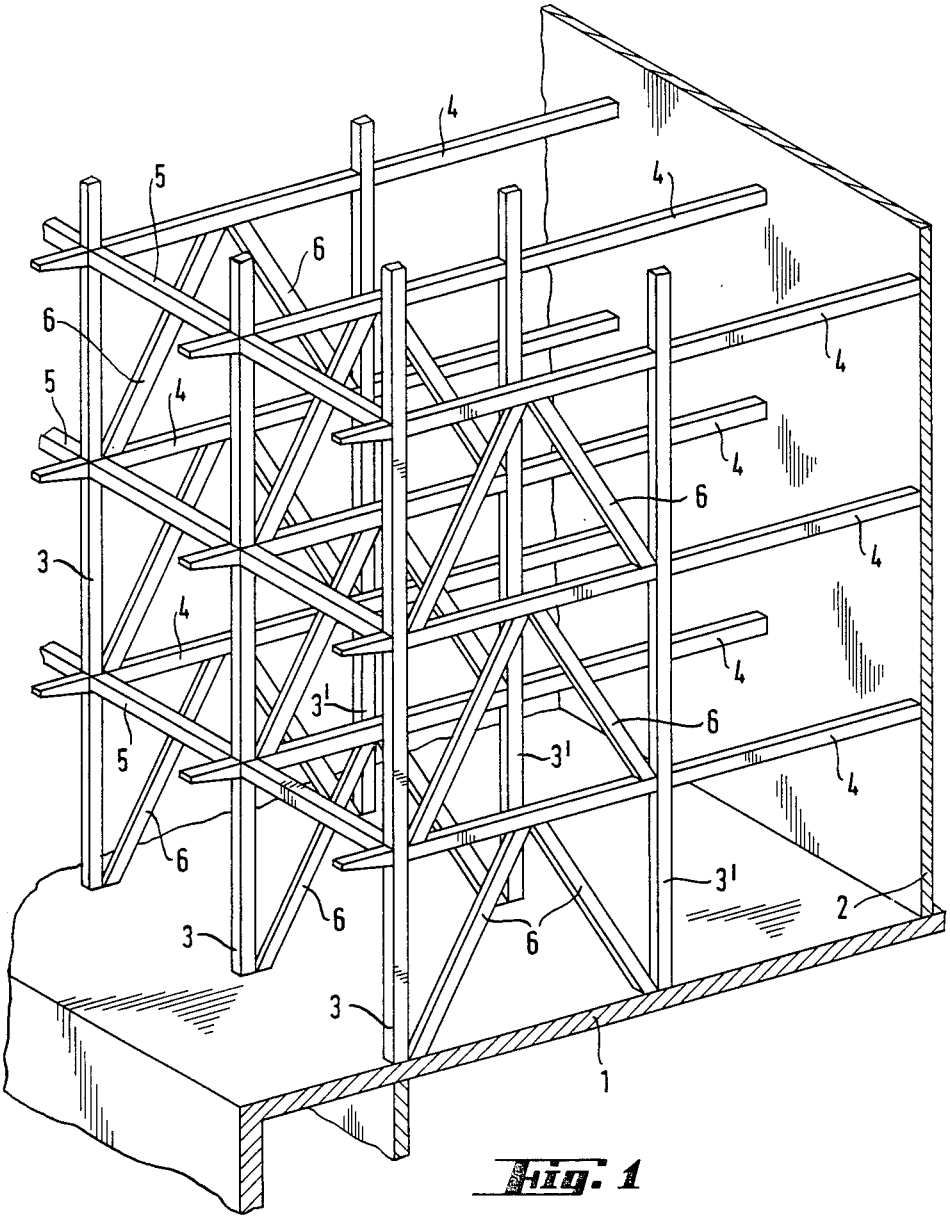

In the drawing, reference 1 relates to the topmost deck of the ship's actual hull, covering the entire hull. Reference 2 relates to the central bulkhead of the superstructure which delimits the intermediate space running through the various levels of the superstructure, containing equipment belonging to the ventilation system, access routes, and servicing apparatus for pipework, etc. According to FIG. 1, the load-bearing frame of the passenger section in the superstructure consists of a three-dimensional latticework or frame formed by vertical pillars 3, 3', and supporting girders 4, 5. The structural material used for the pillars and girders consists of braced steel beams which have been joined to one another by welding. The frame is anchored to deck 1 and supported by bulkhead 2 in order to improve the rigidity of the structure. The rigidity of the structure is further increased by transverse girders 6.

The width of the frame is dimensioned according to the number and length of cabin elements 7 or similar to be installed. The intermediate space occupying the central part of the superstructure is not necessarily required in a design in accordance with this invention, although that would be an advantageous solution. Where no such intermediate space exists, it would, however, be advantageous to arrange for a wall or similar, running through the various levels of the superstructure and delimiting the frames in the crosswise direction of the superstructure, to increase the strength and rigidity of the structure.

There are no restrictions as to the longitudinal dimension of the frame. But by using frames up to 40 meters in length one after another, separated from each other by vertical and transverse walls running through the various levels of the superstructure, it is possible to meet standards of fire safety for this part without any difficulty. Such walls naturally also improve the overall strength of the structure.

Figure 2:
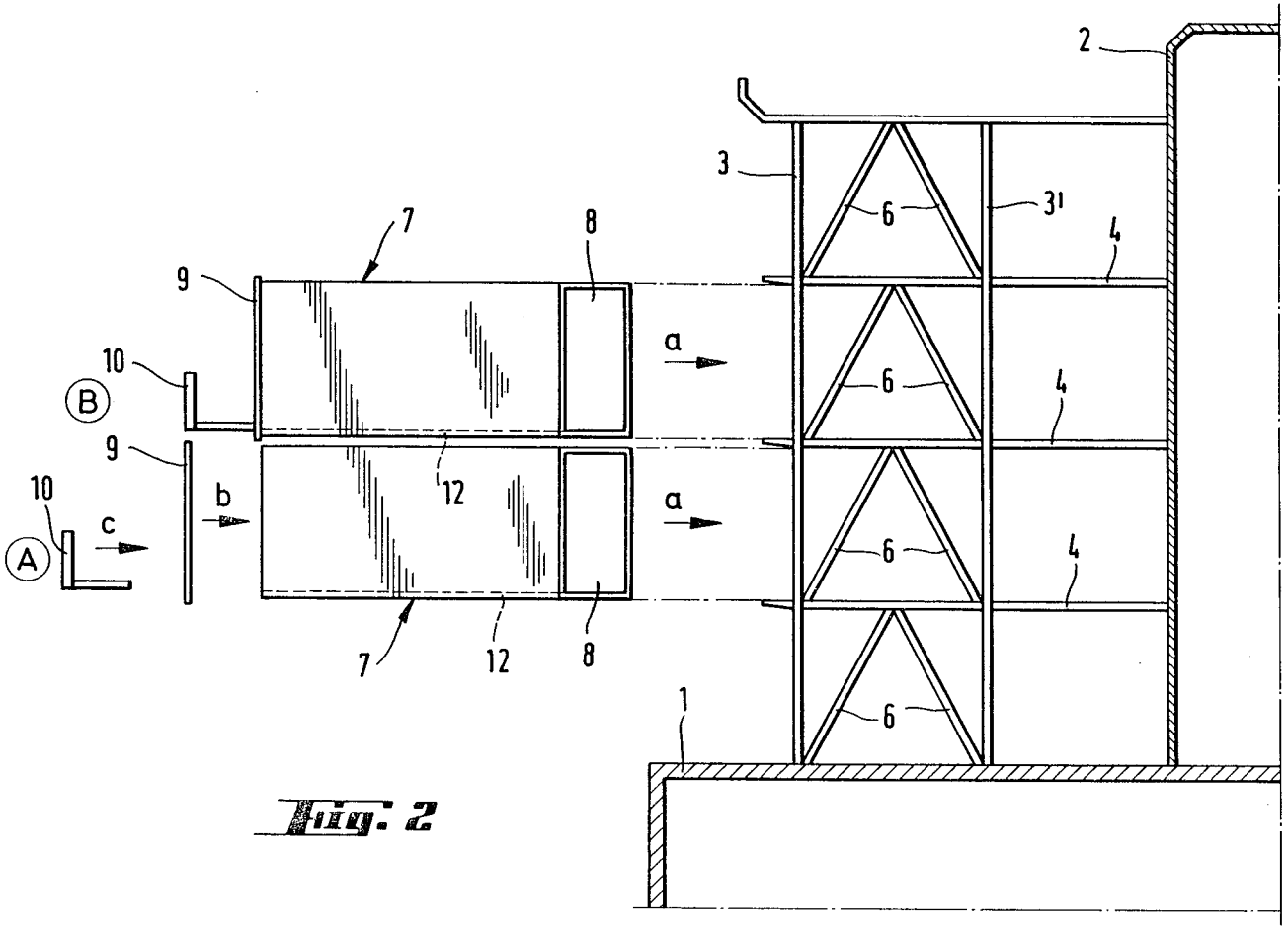
FIG. 2 shows a cabin element installation method according to the invention.

FIG. 2 shows the installation method of the passenger section. Cabin units 7 are inserted into the frame constructed on deck 1 from the side by pushing the units through the openings formed by outboard pillars 3 and longitudinal supporting girders 5 in the direction of arrow a. Cabin units 7 are prefabricated elements comprising a bottom structure, which in addition to the actual cabin area also include corridor section 8. The cabin units may be affixed advantageously by welding them to the frame girders and pillars and/or to the bulkheads incorporated in these. In order to achieve a rigid connection it is essential that the cabin units are supported to the girder at their bottom structure. After the installation of a cabin unit, the cabin's outer bulkhead 9 is installed in direction b, following installation method A. Outer bulkhead 9 incorporates a window element; alternatively the window element may be installed separately in outer bulkhead 9. After this, balcony element 10 is installed outside the cabin (arrow c) and supported on that part of croswise supporting girders 4 which extends outside the cabin assembly. Instead of a balcony element 10 it is, naturally, possible to install other equipment, such as a narrow walking deck, lifeboats or similar, outside the cabin complex. In installation method B shown in FIG. 2, outer bulkhead 9 as well as balcony 10 have been assembled permanently to the cabin element already at the prefabrication stage.

After the installation of cabin unit 7 the assembly of the passenger section is continued using similar elements, and preferably so that the assembly is carried out level after level in the downward direction. It is also possible to complete the assembly of a commenced level, which makes it possible to start electrification and other similar fitting operations. The drawing shows a passenger section in which all the cabins are of the so-called outside cabin type. Within the scope of this invention it is equally possible to build inside cabins, the installation of which is carried out in the same way but prior to that of the outside cabins.

Figure 3:
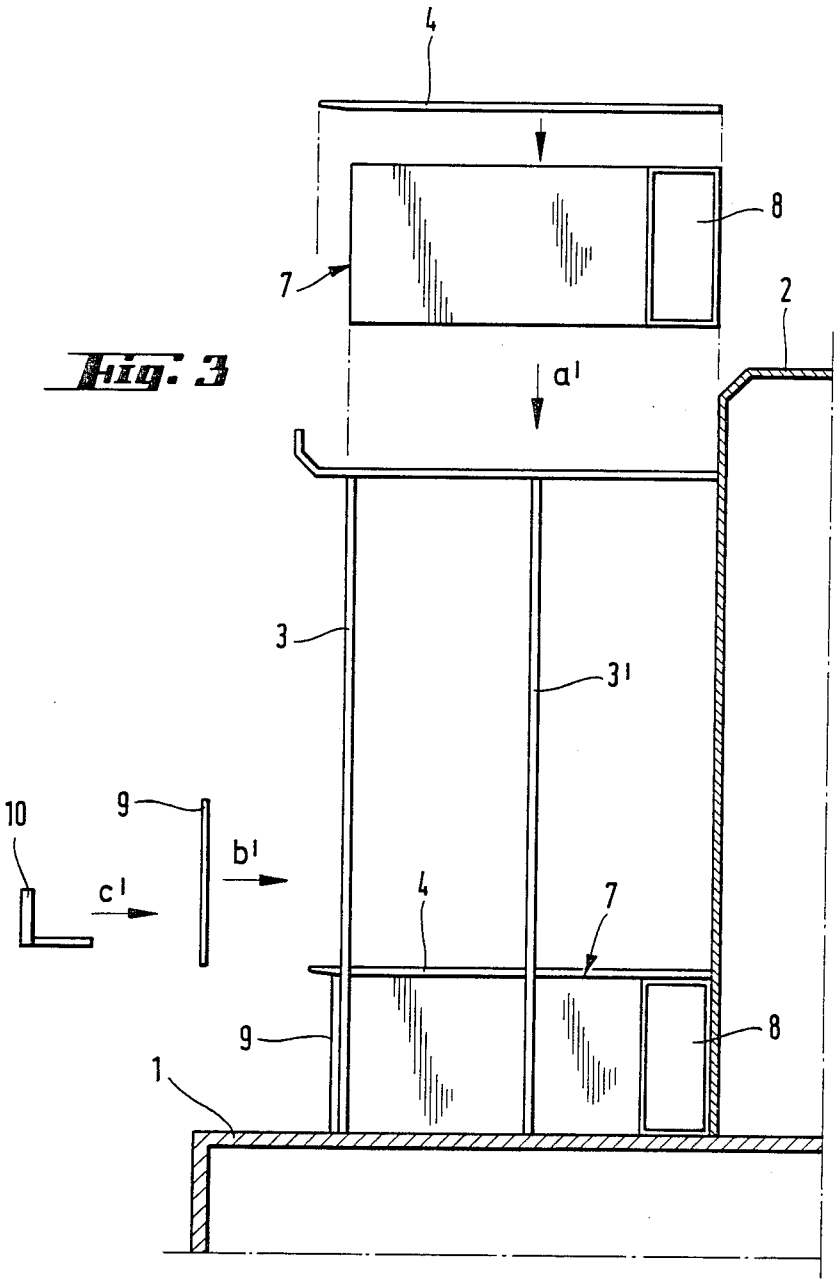
FIG. 3 shows another cabin element installation method according to the invention.

FIG. 3 shows an alternative, vertical installation method. According to this method only vertical pillars, 3,3' and any braces 6 are installed prior to the installation of the cabins. Cabin elements 7 with a bottom construction and incorporating corridor section 8 are installed in the superstructure from above in direction a'. Following the installation of the cabin unit, supporting girders 4, 5 of the next level are installed, to act as supports for the next cabin unit. In this case, outer bulkheads 9 are installed in the frame in sideways direction b' from outside, after which any other fittings 10 may be installed in position (arrow c'). In this installation method, too, it is possible, where so desired, to install elements 9 and 10 prior to the installation of cabin unit 7.

Figure 4:
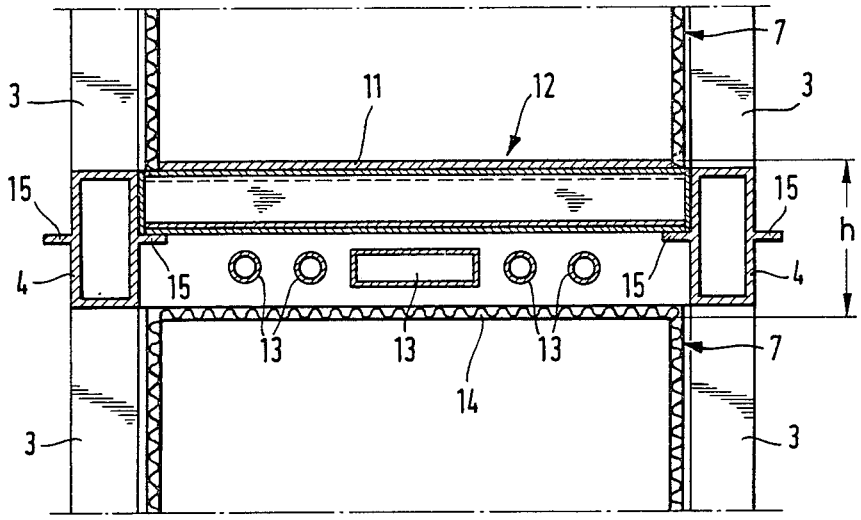
FIG. 4 shows the base structure of a cabin unit according to the invention, in cross-section, seen from the side of the ship.
Figure 5:
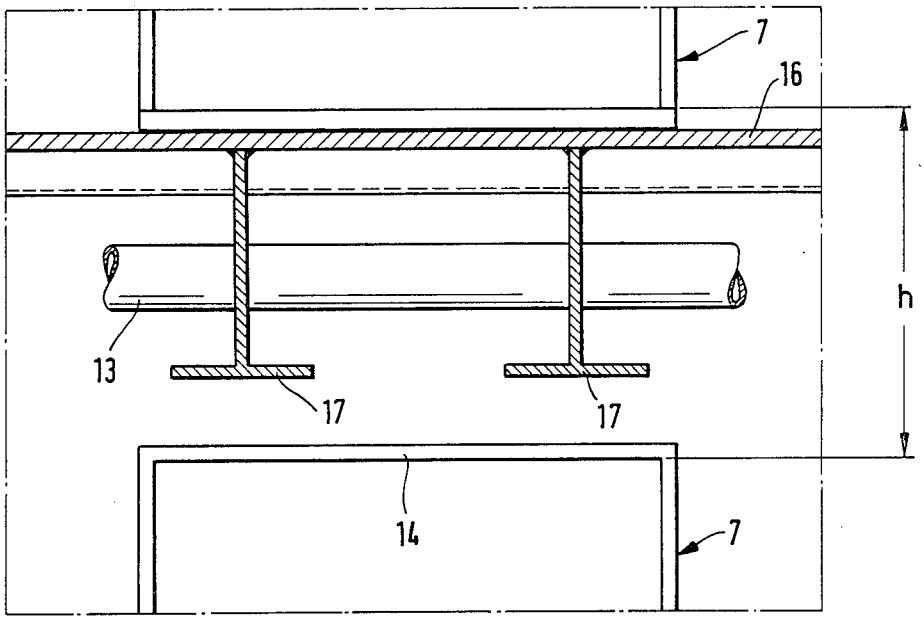
FIG. 5 shows deck construction according to known techniques, in cross-section, seen from the side of the ship.

As shown by FIGS. 4 and 5, the superstructure construction method in accordance with this invention achieves savings in both space and weight as compared with the known techniques. The weight saving is due to the fact that between supporting girders 4, 5, the deck consists of a self-supporting, lightweight structure of the so-called sandwich type, which despite being light in weight ensures the requisite local strength. The space saving is based on the fact that the new structure does not call for separate cross braces 17, the vertical dimension of which results in loss of space. According to the invention, supporting girders 4, 5 function as deck stiffeners, and the floor level of the cabins is partly formed between these girders.

FIG. 4 shows a deck structure in accordance with the invention, in a longitudinal cross-section. The deck consists of corrugated sheet metal which is clad on either side with a thin sheet metal plate. This type of sandwich structure 12 is known to provide excellent strength and rigidity in view of its light weight. Over this structure inside the cabin, a suitable furnishing material 11 is used. Below the floor level, the necessary services for each cabin, such as air ventilation ducts, drain pipes and similar 13, are installed. The floor level is installed in the frame to be supported by flanges 15 of supporting girders 4, 5. With this structure, the vertical intermediate space h between two cabins, from base 11 to ceiling 14, is approx. 200 mm. As a comparison, FIG. 5 shows a deck structure in accordance with known techniques where the intermediate space h between levels is usually up to 400 mm. In FIG. 5 item 16 refers to steel deck structure and item 17 to deck stiffeners.

The cabin elements to be installed according to the method of the invention are fitted with a bottom construction, in other words, the sandwich structure is incorporated in the prefabricated cabin and its corridor section. This is a very advantageous construction method. However, by utilizing the ideas of this invention, it is also possible to assemble the cabins and the corridor only on board the ship. In this case, the framework described above is constructed first, and then the deck's floor level consisting of a sandwich structure is installed on the supporting girders in the frame. Also in this case it is possible to achieve the desired structural lightness and space saving.

The invention is not limited to the described embodiments; on the contrary, ther are several possible versions of the invention feasible within the scope of the attached claims.

We claim:

1. A method of building a superstructure on a ship, which superstructure accommodates a plurality of cabins and the local strength and overall strength of which are at least equal to a minimum local strength and a minimum overall strength respectively, said method comprising:

constructing a three-dimensional latticework over the uppermost deck covering the entire hull of the ship, the overall strength of the latticework being at least substantially equal to said minimum overall strength, installing at least an upper and a lower tier of prefabricated cabin units in the latticework, each cabin unit of the upper tier having a floor structure which is supported by the latticework and of which the local strength is at least equal to said minimum local strength, and installing outer bulkheads for the cabin units after the cabin units have been installed in the latticework.

2. A method according to claim 1, wherein the ship has a rigid wall structure which extends longitudinally of the ship and the method comprises constructing first and second three-dimensional latticeworks on opposite sides respectively of the rigid wall structure, said latticeworks being attached to the rigid wall structure, and installing at least two tiers of prefabricated cabin units in each latticework.

3. A method according to claim 1, wherein the latticework comprises multiple sets of vertical pillars which are secured to and extend upwardly from said uppermost deck, the sets of pillars being spaced apart in the longitudinal direction of the ship and the pillars of each set being spaced apart in the transverse direction of the ship, and horizontal girders which are secured to the pillars whereby the latticework defines a two-dimensional array of cells, and the method comprises installing the cabin units in the cells respectively by pushing a single cabin unit in a horizontal direction between each two adjacent sets of pllars.

4. A method according to claim 1, wherein the threedimensional latticework comprises vertical pillars which are secured to and extend upwardly from said uppermost deck, and the method comprises installing a cabin unit of the lower tier by lowering it between adjacent pillars until it rests on said uppermost deck, securing horizontal support girders between the pillars, and installing a cabin unit of the upper tier by lowering it between adjacent pillars until it rests on the horizontal support girders.

5. A method of building a superstructure on a ship, which superstructure accomodates a plurality of cabins and the local strength and the overall strength of which are at least equal to a minimum local strength and a minimum overall strength respectively, said method comprising, constructing a three-dimensional latticework over the uppermost deck covering the entire hull of the ship, the overall strength of the latticework being at least substantially equal to said minimum overall strength, installing a sandwich-construction deck plate in the latticework, the local strength of the deck plate being at least equal to said minimum local strength, and installing at least a lower and an upper tier of prefabricated cabins in the latticework, the prefabricated cabins being without floor structures and said uppermost deck forming a floor for the cabins of the lower tier and said deck plate forming a floor for the cabins of the upper tier.

6. A method according to claim 5, wherein the deck plate comprises a core of corrugated metal, which core has two opposite sides, and a sheet metal cladding extending over both of said opposite sides.

7. A big passenger ship having a hull, a deck covering the entire hull of the ship, and a superstructure which extends above said deck and of which the local strength and the overall strength are at least equal to a minimum local strength and a minimum overall strength respectively, said superstructure comprising a threedimensional latticework of which the overall strength is at least substantially equal to said minimum overall strength, and at least an upper and a lower tier of cabins arranged one on top of the other in the latticework, each cabin of the upper tier having a floor structure which is supported by the latticework and of which the local strength is at least equal to said minimum local strength and each cabin being a prefabricated unit comprising walls and a ceiling structure and wherein each cabin unit includes a corridor section, the corridor sections of each tier of cabin units being in communication and forming a corridor.

8. A ship according to claim 7, wherein the superstructure comprises a rigid wall structure which extends longitudinally of the ship and to which the latticework is attached, said rigid wall structure defining an intermediate space which runs vertically through the superstructure and contains ducts and pipework.

9. A passenger ship according to claim 7, wherein the floor structure comprises a core of lightweight material, which core has two opposite sides, and a sheet metal cladding extending over both of said opposite sides.

10. A ship according to claim 9, wherein the core is made of corrugated metal.

11. A ship according to claim 7, wherein the threedimensional latticework comprises vertical pillars which extend upwardly from said deck and horizontal supporting girders which are secured to the vertical pillars, and wherein the floor structure of a cabin of the upper tier is supported by the latticework by virtue of its resting on the horizontal supporting girders.

12. A ship according to claim 11, wherein each cabin of the upper tier has an outer bulkhead and the supporting girders are also support balconies or walkways outside said outer bulkheads.

13. A ship according to claim 7, wherein each prefabricated cabin unit includes a floor structure.

14. A ship according to claim 7, wherein the latticework comprises multiple sets of vertical pillars which are secured to and extend upwardly from said uppermost deck, the sets of pillars being spaced apart in the longitudinal direction of the ship and the pillars of each set being spaced apart in the transverse direction of the ship, and a single cabin is positioned between each two adjacent sets of pillars.

15. A big passenger ship having a hull, a deck covering the entire hull of the ship, and a superstructure which extends above said deck and of which the local strength and the overall strength are at least equal to a minimum local strength and a minimum overall strength respectively, said superstructure comprising a three-dimensional latticework of vertical pillars that extend upwardly from said deck and horizontal supporting girders that are secured to the vertical pillars, the overall strength of the latticework being at least substantially equal to said minimum overall strength, and the ship also having at least an upper and a lower tier of cabins arranged one on top of the other in the latticework, each cabin of the upper tier having a floor structure which rests on the horizontal supporting girders and of which the local strength is at least equal to said minimum local strength, each cabin of the upper tier also having an outer bulkhead and the horizontal girders also supporting balconies or walkways outside said outer bulkheads.

16. A ship according to claim 15, in which each cabin is a prefabricated unit comprising walls and a ceiling structure and wherein each cabin unit includes a corridor section, the corridor sections of each tier of cabin units being in communication and forming a corridor.

* * * * *